US006641777B1

(12) United States Patent
Kojo et al.

(10) Patent No.: US 6,641,777 B1
(45) Date of Patent: Nov. 4, 2003

(54) METHOD FOR THE MANUFACTURE OF A COMPOSITE COOLING ELEMENT FOR THE MELT ZONE OF A METALLURGICAL REACTOR AND A COMPOSITE COOLING ELEMENT MANUFACTURED BY SAID METHOD

(75) Inventors: Ilkka Kojo, Kirkkonummi (FI); Risto Saarinen, Espoo (FI); Ari Jokilaakso, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/979,451

(22) PCT Filed: May 12, 2000

(86) PCT No.: PCT/FI00/00431

§ 371 (c)(1),
(2), (4) Date: Nov. 13, 2001

(87) PCT Pub. No.: WO00/73514

PCT Pub. Date: Dec. 7, 2000

(30) Foreign Application Priority Data

May 26, 1999 (FI) ..... 991191

(51) Int. Cl.[7] ..... C21B 7/10
(52) U.S. Cl. ..... 266/193; 266/241; 122/6 B
(58) Field of Search ..... 266/193, 194, 266/241; 122/6 A, 6 B

(56) References Cited

U.S. PATENT DOCUMENTS

| | | | | | |
|---|---|---|---|---|---|
| 4,162,061 | A | | 7/1979 | Buhler et al. | 266/193 |
| 4,892,293 | A | * | 1/1990 | Kato et al. | 266/193 |
| 5,251,882 | A | * | 10/1993 | Kammerling et al. | 266/193 |
| 5,676,908 | A | | 10/1997 | Kubbutat et al. | 266/193 |
| 5,678,806 | A | * | 10/1997 | Hille et al. | 266/193 |
| 6,090,342 | A | * | 7/2000 | Sumigama et al. | 266/193 |

FOREIGN PATENT DOCUMENTS

| | | | | |
|---|---|---|---|---|
| DE | 29 49 998 | | 6/1980 | |
| DE | 3313998 | A1 * | 12/1983 | 266/193 |
| EP | 0 926 247 | | 6/1999 | |
| JP | 1272707 | | 10/1989 | |

* cited by examiner

*Primary Examiner*—Scott Kastler
(74) *Attorney, Agent, or Firm*—Smith-Hill and Bedell

(57) ABSTRACT

The invention relates to a method for the manufacture of a composite cooling element for the melt zone of a metallurgical reactor, whereby the element is manufactured by attaching ceramic lining sections to each other by copper casting and forming at the same time a copper plate equipped with cooling water channels behind the lining. The invention also relates to composite cooling elements manufactured by this method.

38 Claims, 2 Drawing Sheets

METHOD FOR THE MANUFACTURE OF A COMPOSITE COOLING ELEMENT FOR THE MELT ZONE OF A METALLURGICAL REACTOR AND A COMPOSITE COOLING ELEMENT MANUFACTURED BY SAID METHOD

The invention relates to a method for the manufacture of a composite cooling element for the melt zone of a metallurgical reactor, whereby the element is manufactured by attaching ceramic lining sections to each other by copper casting and forming at the same time a copper plate equipped with cooling water channels behind the lining. The invention also relates to composite cooling elements manufactured by this method.

The refractory of reactors in pyrometallurgical processes is protected by water-cooled cooling elements so that, as a result of cooling, the heat coming to the refractory surface is transferred via the cooling element to water, whereby the wear on the lining is significantly reduced compared with a reactor which is not cooled. Reduced wear is caused by the effect of cooling, which brings about forming of so-called autogenic lining, which fixes to the surface of the heat resistant lining and which is formed from slag and other substances precipitated from the molten phases.

Conventionally, cooling elements are manufactured in three ways: primarily, elements can be manufactured by sand casting, where cooling pipes made of a highly thermal conductive material such as copper are set in a sand-formed mould, and are cooled with air or water during the casting around the pipes. The element cast around the pipes is also of highly thermal conductive material, preferably copper. This kind of manufacturing method is described in e.g. GB patent no. 1386645. One problem with this method is the uneven attachment of the piping acting as cooling channel to the cast material surrounding it. Some of the pipes may be completely free of the element cast around it and part of the pipe may be completely melted and thus fused with the element. If no metallic bond is made between the cooling pipe and the rest of the cast element around it, heat transfer will not be efficient. Again if the piping melts completely, that will prevent the flow of cooling water. Advantages of this method are the comparatively low manufacturing costs and independence of dimensions.

Another cooling element manufacturing method of the above type is to manufacture elements by sand casting, with cooling pipes made of some other material than copper. Copper is cast around the pipes on a sand bed, and then, by overheating the casting copper a good contact is achieved between the copper and the pipes. However, in general, the thermal conductivity of said pipes is only of the order of 5–10% that of pure copper. This weakens the cooling ability of the elements, especially in dynamic situations.

U.S. Pat. No. 4,382,585 describes another, much used method of manufacturing cooling elements, according to which the element is manufactured for example from rolled or forged copper plate by machining the necessary channels into it. The advantage of an element manufactured this way, is its dense, strong structure and good heat transfer from the element to a cooling medium such as water. Its disadvantages are dimensional limitations (size) and high cost.

The biggest weakness in cooling elements fabricated with the methods mentioned above, is that it is difficult to obtain a good contact at the fitting stage between the ceramic furnace lining it is meant to protect (the fireproof lining) and the element. This means that the protective effect of the cooling element on the ceramic lining is greatly dependent on the success of the fitting, and very often it is not possible to take full advantage of the cooling properties of the element.

Now a method has been developed whereby a fixed metallic contact is made between the ceramic lining of the metallurgical reactor and a copper plate behind it furnished with cooling water piping, together forming a composite cooling element. This occurs best when the sections of the ceramic lining such as fireproof burnt bricks, are joined to each other by casting molten copper between the bricks and at the same time casting a copper plate behind the surface formed by the ceramic units. The rear section copper plate is furnished with cooling water channels, preferably double channels. The invention also relates to the composite cooling element itself, with a surface section formed of ceramic bricks in between which high thermal conductivity copper is cast, and where a copper plate furnished with cooling water channels is cast at the same time behind the surface section. The essential features will become apparent in the attached patent claims.

In practice, the cooling element is formed so that copper is cast around the burnt ceramic bricks so that the ceramic brickwork is largely formed during casting and makes a good contact with the cast copper. Due to the great thermal conductivity of copper, the protective effect of copper joints on the brickwork is effective. So that heat is not transferred needlessly, the copper joints between the bricks are made as thin as possible, preferably for technical reasons 0.5–2 cm thick. If the joints are thicker, they will conduct too much heat from the furnace to cooling, needlessly increasing heat losses and operating costs. The preferable amount of copper in the surface section of the cooling element (the section going into the inside of the reactor) in ratio to the ceramic lining is maximum 30% of the surface area, i.e. the amount of joining material should not become too massive, because the aim is not to increase total heat losses but to protect the brickwork.

Burnt bricks suitable for casting are used as the ceramic lining material, i.e. brick material, as they traditionally have good properties against metallurgical melts. The copper is a grade with high electrical conductivity, preferably higher than 85% IACS, since there is a direct dependency on the electrical and thermal conductivity of copper.

While the bricks are being joined together, a copper plate in which cooling water channels are worked, is cast behind the ceramic lining. The channels are made as double-pipe channels in the rear section of the element formed by the copper plate, e.g. by drilling so that first the outer pipe is drilled, with walls profiled to increase the heat transfer surface. An inner pipe with a smaller diameter is placed inside the outer pipe, and water is fed in through this inner pipe to the element and out through the profiled outer pipe. Using profiles, such as grooves, flutes, threads or similar on the inner surface of the pipe, the heat transfer surface of the wall can be increased by as much as double compared with a smooth surface.

Channels are made in the heat transfer element so that there is a distance of maximum 0.5–1.5 times the diameter of the channel between the channels, and is therefore a fixed part of the element. If the channels are made closer together, no benefit will be obtained, since then the heat transfer surface of the back of the channels would be utilized needlessly and also the structure would be weakened. If, on the other hand, the channeling is made farther apart, maximization of the heat transfer surface will not be utilized and then the cooling capacity will be lessened.

As mentioned above, an inner pipe is placed inside each drilled pipe in the heat transfer element, through which cooling water is conveyed into the element. From the inner pipe the water flows on in the ring-like channel formed by the outer and inner pipes and out to circulation. The double-pipe structure facilitates a reduction in flow cross-sectional area so that a higher rate is achieved with a certain amount of water than if only one pipe were used. A higher flow rate has in turn a significantly positive effect on the heat transfer between the element and the water. If the heat transfer surface is optimized using conventional smooth pipes, such an increase in heat transfer surface area could not be attained since the quantities of water would be excessively great.

The heat transfer elements are joined to each other tightly by making the sides of the elements into tongues and grooves or overlapping them so that the chinks in adjacent elements form a labyrinth.

BRIEF DESCRIPTION OF THE DRAWINGS

A heat transfer element according to this invention is described further by means of the attached diagrams, where

FIGS. 1 and 2 show that the surface part of heat transfer element 1, in other words the wall going inside the reactor is formed of ceramic lining 2. The ceramic lining in turn is formed of for example burnt bricks 3, which are joined to each other by casting copper as a joint material 4 between the bricks so that the ratio of the joint material to the ceramic surface area is maximum 30/70. While the bricks are joined to each other to form a uniform ceramic lining, a copper plate 5 is cast behind the lining, into which the required cooling channels 6 are worked. In order to attach the cooling elements to one another, the edge of one end of the element can always be made thinner, whereby the elements are placed overlapping the adjacent ones. Another option is to furnish the elements with lugs and grooves (a tongue-and-groove joint) in order to obtain the tightest contact, so that a tight joint is made when fitting the elements to each other.

FIG. 2 also shows the preferred double piping arrangement for the cooling water piping, whereby the element itself is worked by drilling a hole 7, for instance, which acts as the outer pipe, and the surface of said pipe is profiled as desired to achieve a large flow cross-section. An inner pipe 8 smaller in diameter is placed inside the outer pipe, and cooling water is fed into the element through said inner pipe. The inner pipe does not reach the bottom of the outer pipe, but is left shorter, and the cooling water flows around the ring-like space formed around the inner pipe back to the same end from which it was fed to exit via an outlet 9. The cross-sectional area of the ring-like space is the same as the inner pipe or preferably smaller, so that the flow rate in the outer pipe increases. When pressure loss increases in the area of heat transfer, this also has a preventive effect on localized boiling of water.

In some situations it may be advantageous to arrange the cooling of the cooling element in some other way than with the above-mentioned double-pipe, for example, by fabricating the piping normally by boring and plugging without double piping. In this case too, it is preferable to keep the same copper-ceramic ratio of 30/70.

Figure 3:
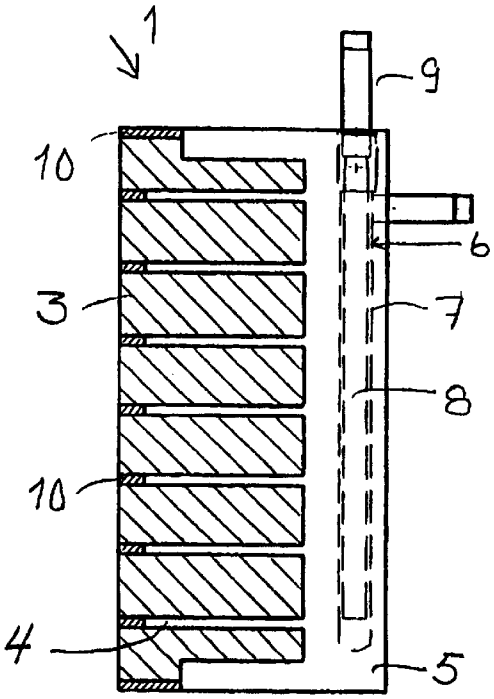
FIG. 3 is another heat transfer element according to the invention as seen from the side in cross-section.
Figure 2:
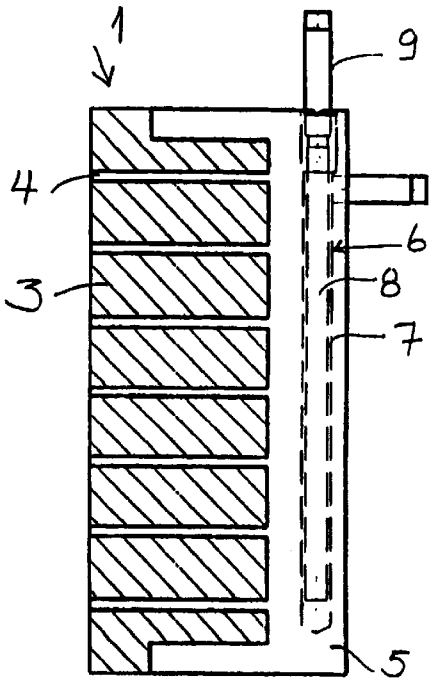
FIG. 2 shows a heat transfer element as seen from the side in cross-section.
Figure 1:
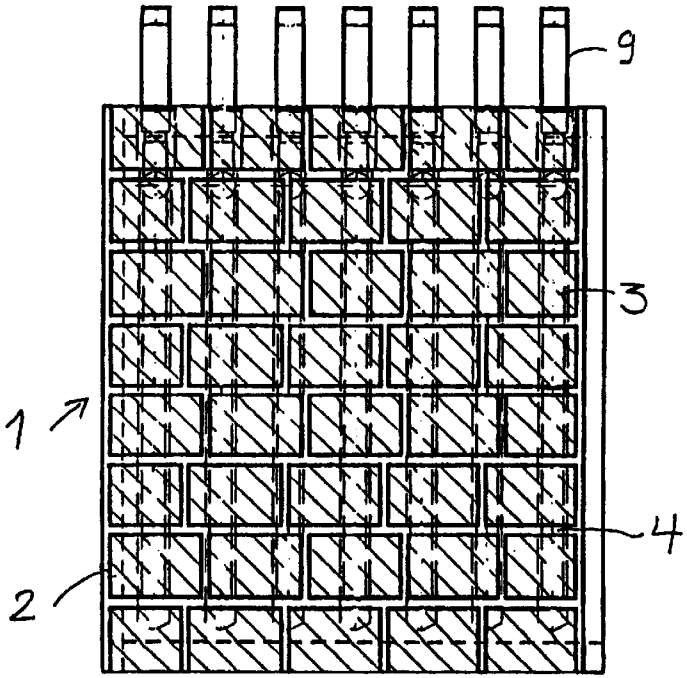
FIG. 1 shows a heat transfer element as seen from the front.

FIG. 3 presents another alternative fabrication of a composite element. When blister copper is produced in a metallurgical reactor, it is not desirable to put the copper used for cooling element jointing in direct contact with the copper being produced, because their melting point is essentially the same. In spite of the cooling, either the copper in the element may melt slightly or the blister may form a solid layer on top of the ceramic lining, and the situation is difficult to control. In this case, it is advantageous to make the casting so that a frame of for instance fireproof steel is made in which the bricks are assembled. The height of the frame is around 1–3 cm and this comes into contact with both the ceramic (brick) and the copper to be cast on top. Thus the frame 10 forms the surface section of the jointing between the bricks in the finished elements, as shown in FIG. 3.

It is advantageous that the frame, i.e. the surface of the jointing between the bricks in the finished element, which will come into contact with copper, is worked so that the molten copper to be cast on top will set into cavities, which may be for instance fin-like. This increases the heat transfer surface between the steel and the copper and also binds the copper and steel closely together.

Figure 4:
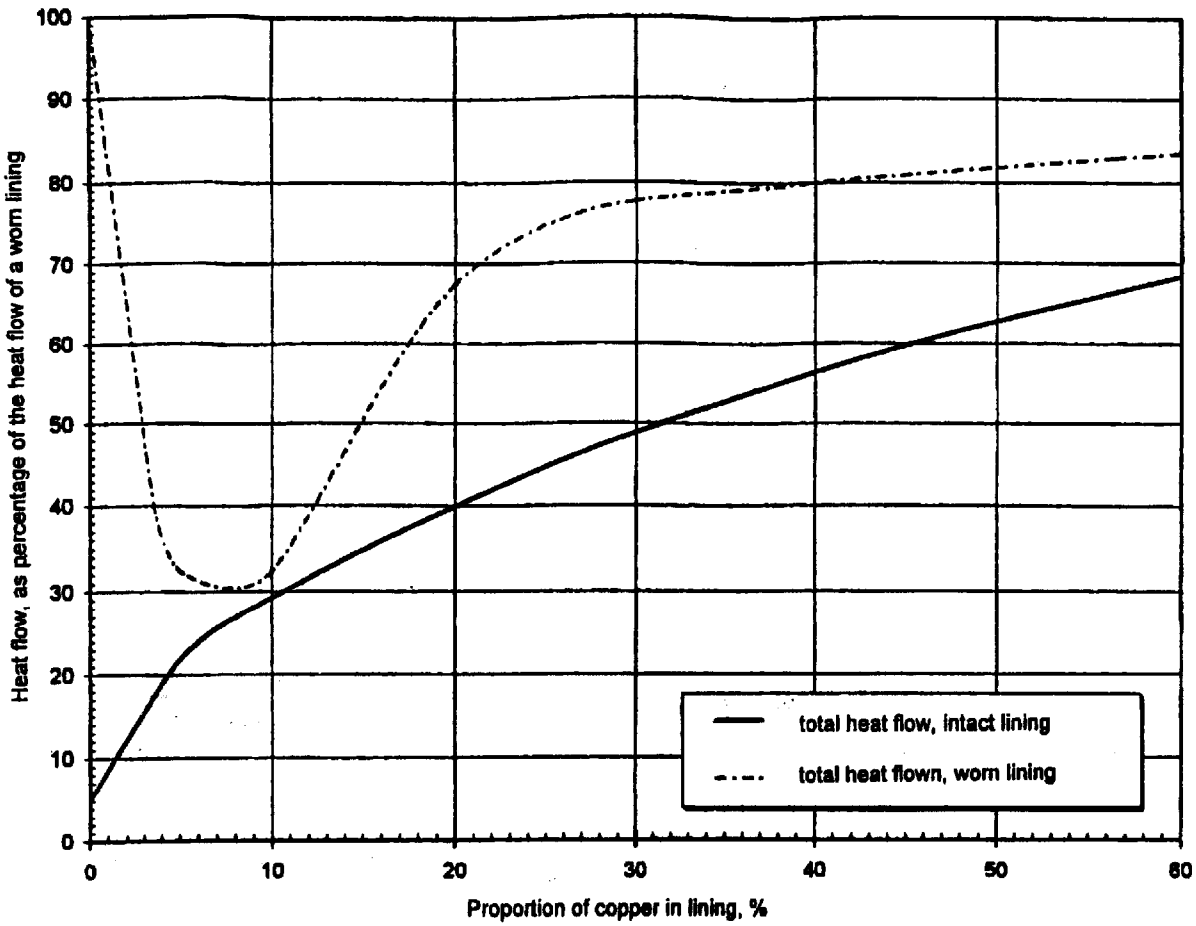
FIG. 4 is a graph showing heat losses as a function of the amount of copper in the ceramic surface.

FIG. 4 shows how heat losses (heat flow as a percentage of the heat flow of a worn lining) change through the reactor wall when the proportion of copper in the element changes in the heat transfer element. Heat losses in the case of an intact lining decrease almost linearly, when the proportion of ceramic lining increases and the total heat losses decrease, until the proportion of copper drops below 10%, in which case the slope becomes steeper.

Normally the linings of the reactor walls wear as the combined effect of the temperature and the penetration of the molten material, whereby the insulation is weakened and heat losses increase. The temperature of a lining cooled only from the back (copper 0%) rises so high that the penetration of molten material increases and erosion is able to proceed until finally only a thin layer of bricks remains stable on the surface of a level copper element. When there is some copper inside the element, the temperature of the refractory is essentially lower and the penetration of the molten material decreases. In such a case, heat losses drop as the copper proportion in the lining is reduced up to a certain limit (20–30% Cu), after which heat losses decrease steeply, but they increase again when the proportion of copper drops below the critical level (about 5%). According to FIG. 4 there should be a maximum of 30% copper in the lining, with the optimal range lying between 5–15%.

What is claimed is:

1. A method for manufacturing a composite cooling element for the melt zone of a metallurgical reactor, comprising:

placing ceramic lining sections in a framework made of steel, and casting molten copper over the ceramic lining sections and the framework to join the ceramic lining sections and the framework to each other and to form a copper plate over the ceramic lining sections, whereby the framework is disposed between the ceramic lining sections at an interior surface of the composite cooling element and the copper plate is outward of the ceramic lining sections.

2. A method according to claim 1, further comprising forming cooling water channels in the copper plate.

3. A method according to claim 2, comprising forming the cooling water channels by drilling.

4. A method according to claim 2, wherein the cooling water channels are of uniform cross-section.

5. A method according to claim 4, wherein the cooling water channels are of uniform circular cross-section.

6. A method according to claim 5, wherein the cooling water channels are of substantially equal diameter and are spaced from each other at a distance of 0.5 to 1.5 times the diameter of the channels.

7. A method according to claim 2, comprising installing inner pipes in the cooling water channels.

8. A method according to claim 1, wherein the ceramic lining sections comprise refractory bricks.

9. A method according to claim 8, wherein copper joints having a thickness of 0.5 to 2 cm are formed between the refractory bricks.

10. A method according to claim 1, wherein the copper has an electrical conductivity of at least 85% IACS.

11. A method according to claim 1, wherein the framework is made of fireproof steel and has a thickness of 1 to 3 cm.

12. A method according to claim 1, wherein the framework is formed with cavities into which the molten copper is cast.

13. A method according to claim 12, wherein the cavities are configured so that the copper in the cavities is in the form of fins.

14. A composite cooling element for the melt zone of a metallurgical reactor, the cooling element having an interior surface and comprising ceramic lining sections, metal disposed between the ceramic lining sections, and a copper plate outward of the ceramic lining sections, wherein the metal that is between the ceramic lining sections at the interior surface of the cooling element is steel and the metal that is between the ceramic lining sections outward of the steel is cast copper that attaches the ceramic lining sections to each other and forms the copper plate.

15. A composite cooling element according to claim 14, wherein the copper plate is formed with cooling water channels.

16. A composite cooling element according to claim 15, wherein the cooling water channels are of uniform cross-section.

17. A composite cooling element according to claim 16, wherein the cooling water channels are of uniform circular cross-section.

18. A composite cooling element according to claim 17, wherein the cooling water channels are of substantially equal diameter and are spaced from each other at a distance of 0.5 to 1.5 times the diameter of the channels.

19. A composite cooling element according to claim 15, comprising inner pipes located in the cooling water channels.

20. A composite cooling element according to claim 14, wherein the ceramic lining sections comprise refractory bricks.

21. A composite cooling element according to claim 14, wherein the metal between the ceramic lining sections has a thickness of 0.5 to 2 cm.

22. A composite cooling element according to claim 14, wherein the copper has an electrical conductivity of at least 85% IACS.

23. A composite cooling element according to claim 14, wherein the metal that is between the ceramic lining sections at the interior surface of the cooling element is fireproof steel and has a thickness of 1 to 3 cm.

24. A composite cooling element according to claim 14, wherein the steel is formed with cavities into which the molten copper is cast.

25. A composite cooling element according to claim 24, wherein the cavities are configured so that the copper in the cavities is in the form of fins.

26. A composite cooling element made by a method that comprises:

placing ceramic lining sections in a framework made of steel, and casting molten copper over the ceramic lining sections and the framework to join the ceramic lining sections and the framework to each other and to form a copper plate over the ceramic lining sections, whereby the framework is disposed between the ceramic lining sections at an interior surface of the composite cooling element and the copper plate is outward of the ceramic lining sections.

27. A composite cooling element according to claim 26, made by a method and further comprises forming cooling water channels in the copper plate.

28. A composite cooling element according to claim 27, made by a method that comprises forming the cooling water channels by drilling.

29. A composite cooling element according to claim 26, wherein the cooling water channels are of uniform cross-section.

30. A composite cooling element according to claim 29, wherein the cooling water channels are of uniform circular cross-section.

31. A composite cooling element according to claim 30, wherein the cooling water channels are of substantially equal diameter and are spaced from each other at a distance of 0.5 to 2.5 times the diameter of the channels.

32. A composite cooling element according to claim 27, comprising inner pipes located in the cooling water channels.

33. A composite cooling element according to claim 26, wherein the ceramic lining sections comprise refractory bricks.

34. A composite cooling element according to claim 33, made by a method wherein copper joints having a thickness of 0.5 to 2 cm formed between the refractory bricks.

35. A composite cooling element according to claim 26, wherein the copper has an electrical conductivity of at least 85% IACS.

36. A composite cooling element according to claim 26, wherein the framework is made of fireproof steel and has a thickness of 1 to 3 cm.

37. A method according to claim 26, wherein the framework is formed with cavities and the method comprises casting the molten copper into the cavities.

38. A method according to claim 37, wherein the cavities are configured so that the copper in the cavities is in the form of fins.

* * * * *